United States Patent [19]

Otoshima

[11] Patent Number: 5,065,950

[45] Date of Patent: Nov. 19, 1991

[54] TRAVERSE DRUM

[75] Inventor: Hiroo Otoshima, Shiga, Japan

[73] Assignee: Murata Kikai Kabushiki Kaisha, Kyoto, Japan

[21] Appl. No.: 600,322

[22] Filed: Oct. 19, 1990

[30] Foreign Application Priority Data

Oct. 25, 1989 [JP] Japan ..... 1-277648

[51] Int. Cl.[5] ..... B65H 54/48

[52] U.S. Cl. ..... 242/43.2

[58] Field of Search ..... 242/43.2

[56] References Cited

U.S. PATENT DOCUMENTS 2,147,212 2/1939 Parks ..... 242/43.2
3,022,021 2/1962 Zollinger ..... 242/43.2

FOREIGN PATENT DOCUMENTS 402849 3/1943 Italy ..... 242/43.2
19692 9/1965 Japan .
18509 6/1972 Japan .
1072825 6/1967 United Kingdom ..... 242/43.2

*Primary Examiner*—Stanley N. Gilreath
*Attorney, Agent, or Firm*—Spensley Horn Jubas & Lubitz

[57] ABSTRACT

A traverse drum in which a pin crosses a first groove is provided at position defining a short traverse length in an intersection of the first groove and a second groove, and a wall portion extending from a position where the pin crosses the first groove is formed in the second groove extending from the intersection to divide it into two grooves.

2 Claims, 1 Drawing Sheet

TRAVERSE DRUM

FIELD OF THE INVENTION

This invention relates to a traverse drum for winding a yarn while traversing it in a drum winder.

RELATED ART STATEMENT

Generally, in warping, a cheese winding of a 5 in. traverse is used, and for weft yarns of looms and yarn-feed of knitting machines, a cone winding package of 6 in. traverse is used. Normally, these have been wound by exclusive-use drum winders, respectively, or they are wound by the same winder after replacing the drum. To replace the drum, a cradle, a suction mouth, a drum cover and an end-drop preventive cover need also be replaced in addition to the drum. About three hours is required to replace these members.

There is a configuration wherein a traverse drum for a 5 in. cheese winding is extended to also serve for a 6 in. cone winding. In this configuration a drum groove is partly extended by a predetermined portion at the same lead angle as the existing groove. A pin crosses the drum groove between the existing portion and the extended portion in the drum groove so that use of the 5 in. cheese winding and 6 in. cone winding is divided. Such a mechanism wherein a pin crosses the groove is known and includes one wherein it is inserted into and removed from the end of the drum (see Japanese Patent Publication No. 40-19692) and one wherein it is slidably fixed by a screw or the like in a recess formed in the surface of the drum (see Japanese Utility Model Publication No. 47-18509).

In a conventional traverse drum of a concurrent-use type in which an existing drum groove is extended by a predetermined portion of 0.5 at the same lead angle as the existing groove, when a cone having a relatively large angle is wound, it is wound with high density in a portion having a small diameter of a package. This poses a problem in that winding is difficult as it is.

Object and Summary of the Invention

An object of the invention is to provide a traverse drum capable of obtaining a package in which winding density is even.

For achieving the aforesaid object, an embodiment of the present invention provides a traverse drum in which a pin crosses a deep groove at a position defining a short traverse length in an intersection of a guide groove, and a wall portion extending from a position where said pin crosses the deep groove is formed in a groove extending from said intersection to divide it into two shallow grooves.

In the traverse drum configured as described above, a yarn guided from the deep groove on the left hand above the intersection to the intersection according to movement of the pin into and out of the deep groove is switched to be guided into the shallow groove or guided into the deep groove. Thereby, in case of the former, the traverse length is short, and in case of the latter, it is long.

The yarn guided from the deep groove on the right-hand above the intersection to the intersection is guided into the shallow groove.

DETAILED DESCRIPTION OF PREFERRED EMBODIMENT

An embodiment of the invention will be described hereinafter with reference to the drawings.

Figure 1:
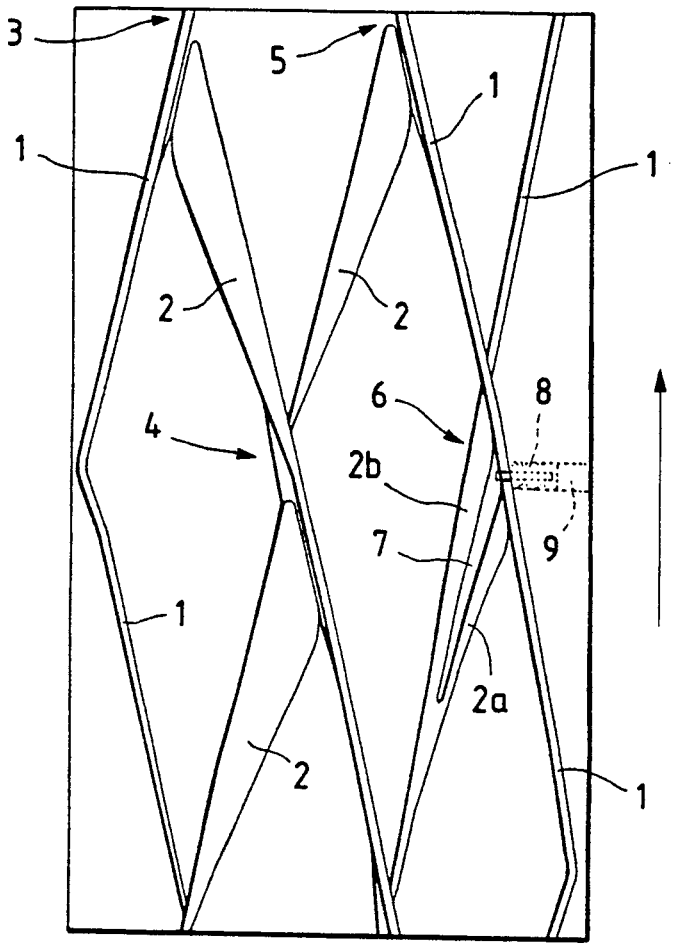
FIG. 1 is a developed view of a traverse drum according to this invention.

FIG. 1 is a developed view of a traverse drum according to this invention.

In the guide groove of the traverse drum, when the traverse drum rotates the yarn traverses the drum. The traverse drum of this invention is a so-called 2.5 wind type in which when the drum rotates two and a half times, the yarn takes one traverse across the drum.

In intersections 3, 4, 5 and 6 of the guide groove, a deep groove 1 and a shallow groove 2 are suitably formed so that the yarn will not move to the other intersecting guide groove.

A traverse length of the traverse drum is determined according to the range in which the guide groove is formed. In this embodiment, the length is 6 in. so as to correspond to a 6 in. cone package. In the intersection 6 located on the utmost right-hand in FIG. 1, a hole 9 for receiving a pin 8 which crosses a deep groove 1 is formed axially of the traverse drum, and a distance between the deep groove 1 at that portion and the deep groove 1 on the left end in FIG. 1 is set to be 5 in.

A shallow groove 2 extending from the intersection 6 is divided into two parts by a wall poriton 7 with a border at a portion from which a pin 8 is extended. On the right-hand is located a shallow groove 2*a* for 5 in. cheese, and on the left-hand is a shallow groove 2*b* for 6 in. cone.

Figure 2:
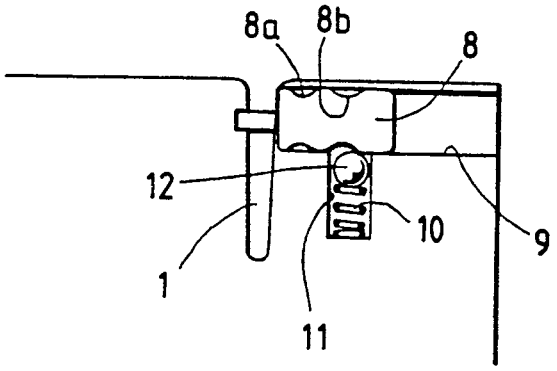
FIG. 2 is a longitudinal sectional view of a pin inserting portion of the traverse drum.

FIG. 2 shows a mounting construction of a pin 8. A hole 11 for receiving a spring 10 is provided perpendicularly to a hole 9. In the circumference of the pin 8 are formed two small diameter portions. A spherical body 12 urged by the spring 10 is in engagement with the small diameter portions 8*a* and 8*b*.

How to properly use the shallow groove 2*a* and the shallow groove 2*b* will be described.

The traverse drum rotates in a direction as indicated at the arrow shown in FIG. 1, and the yarn is guided in the guide groove as if it moves in an opposite direction.

First, where the traverse drum is used for the 6 in. cone, the spherical body 12 causes engages the small diameter portion 8*a* on the left hand in FIG. 2 of the engaging pin 8. The yarn guided from the deep groove 1 on the left hand above the intersection 6 to the intersection 6 is guided to move straight ahead since the pin 8 is not present within the deep groove 1. The yarn guided from the deep groove 1 on the right hand above the intersection 6 to the intersection 6 is guided to the shallow groove 2*b*. Accordingly, it is guided in the guide groove of the long 2.5 wind.

In the case where the traverse drum is used for the 5 in. cheese, the spherical body 12 engages the small diameter portion 8*b* on the right hand in FIG. 2 of the engaging pin 8. The yarn guided from the deep groove 1 on the left hand above the intersection 6 to the intersection 6 rides on the pin 8 when moving at the intersection 6 since the pin 8 is present in a state where it crosses the deep groove 1, whereby the yarn is floated from the bottom of the deep groove 1 to prevent the yarn from being moved into the deep groove 1. In addition, since the yarn guide is present in the central portion, the yarn moves while being pulled toward the center and is guided into the shallow groove 2*a*. Accordingly, it is guided in the guide groove of short 2-wind.

Since this invention is configured as described above, it exhibits the following effects.

That is, a plurality of packages such as packages of 5 in. and 6 in. which has a winding width of predetermined dimension and even winding density can be produced by a single traverse drum. Furthermore, naturally, it is not necessary to replace a traverse drum and parts thereof when a winding width of a package is changed.

What is claimed is:

1. A traverse drum comprising:

a first groove for guiding yarn across the traverse drum along a first traverse path, a second groove for guiding yarn across the traverse drum along at least one additional traverse path, a movable pin provided at a position defining a predetermined traverse length at an intersection of the first and second grooves, the pin being movable between at least first and second positions, wherein in the first position the movable pin crosses the first groove, and a wall portion, formed in the second groove and extending from the position where the movable pin crosses the first groove so as to divide the second groove into two grooves.

2. A traverse drum according to claim 1, wherein at least two smaller diameter portions are formed along a length of the pin, and the traverse drum includes:

a hole provided perpendicular to the pin, a positioning device provided in the hole which engages the smaller diameter portions of the pin to position the pin in the at least two positions, and a spring which is inserted in the hole for providing a biasing force to hold the positioning device in engagement with one of the smaller diameter portions.

* * * * *